United States Patent [19]

Shephard

[11] 4,040,535

[45] Aug. 9, 1977

[54] CONDENSATION PROOF DRINKING GLASS ASSEMBLY

[75] Inventor: Donald L. Shephard, Memphis, Mich.

[73] Assignee: Helen I. Shephard, Memphis, Mich. ; a part interest

[21] Appl. No.: 615,250

[22] Filed: Sept. 22, 1975

[51] Int. Cl.[2] ..... B65D 23/06

[52] U.S. Cl. ..... 215/100.5; 215/12 R

[58] Field of Search ..... 215/100.5, 12 A, 12 R, 215/13 R; 220/9 R, 15, 108; 248/346.1

[56] References Cited

U.S. PATENT DOCUMENTS

| | | | |
|---|---|---|---|
| 973,085 | 10/1910 | Strause | 215/100.5 X |
| 1,957,263 | 5/1934 | Gray | 215/100.5 |
| 3,121,522 | 2/1964 | Ragnow | 220/15 X |
| 3,484,011 | 12/1969 | Greenhalgh | 215/12 R |
| 3,633,863 | 1/1972 | Abbey | 200/100.5 |
| 3,942,667 | 3/1976 | Thomas | 215/12 R |
| D. 202,119 | 8/1965 | Shelby | D7/14 |

*Primary Examiner*—Ro E. Hart

*Attorney, Agent, or Firm*—Cullen, Settle, Sloman & Cantor

[57] ABSTRACT

A condensation proof glass assembly includes a cup of plastic material having an inner wall surface and a bottom wall, and a glass container having a similarly shaped outer wall surface and a bottom wall, snugly projected down into the cup, with the bottom walls spaced apart defining a spill over and condensation reservoir. A plurality of upright grooves in the outer surface of the container define corresponding ridges engaging the cup, with the grooves forming a series of drip channels conducting water to the reservoir.

2 Claims, 2 Drawing Figures

CONDENSATION PROOF DRINKING GLASS ASSEMBLY

BACKGROUND OF THE INVENTION

In the use of conventinal drinking glasses, and particularly in warm and hot weather, though not limited thereto condensation frequently forms upon the exterior of the glass, gets the hand wet, runs down and accumulates on the bottom of the glass and can be damaging to furniture. It is otherwise generally uncomfortable. Often paper napkins are used surrounding the lower portion of the glass for accumulating such moisture and for protecting the hands or a furniture surface.

SUMMARY OF THE INVENTION

It is an object of the present invention to provide an improved glass assembly comprising a cup of plastic material which receives and snugy supports and engages the lower portion of a drinking glass with drip channels in the outer surface of the glass for conducting any accumulated condensation or moisture to the interior bottom of the holding cup.

It is another object to provide an improved condensation proof glass assembly which includes the combination with a plastic outer cup of a drinking glass projected down there into acting as an insulator for the glass, protecting the hands against moisture and preventing the accumulation of water and moisture or spill over on the exterior of the glass, accumulating same within a reservoir between the glass and cup bottoms.

These and other objects will be seen from the following specification and claims in conjunction with the appended drawing.

THE DRAWING

Figure 1:
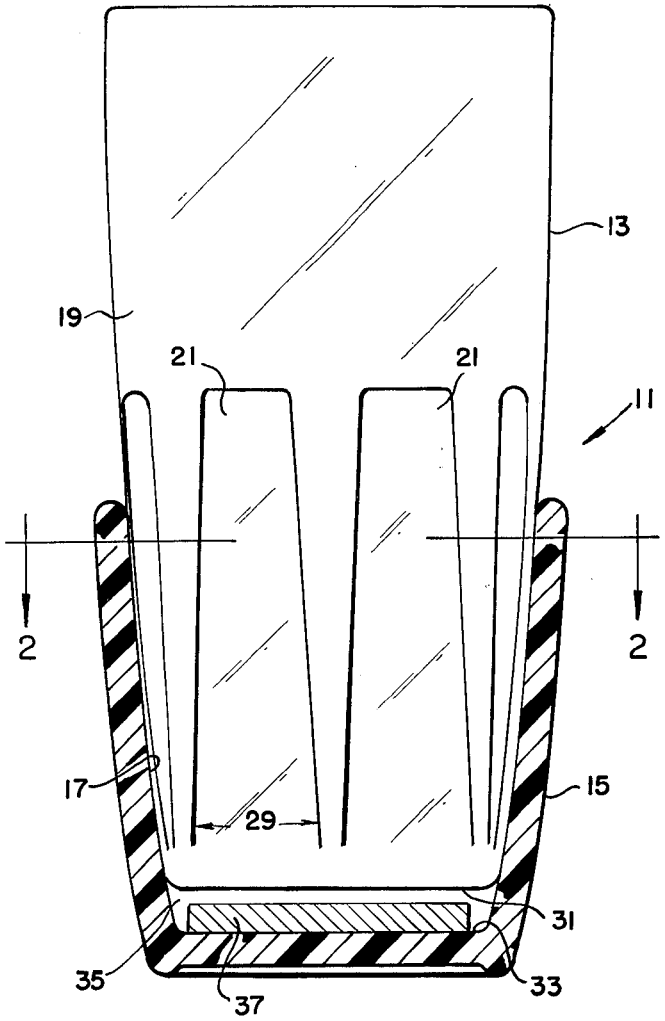
FIG. 1 is a vertical section of the plastic insulator cup with the present glass projected down thereinto.

It will be understood that the above drawing illustrates merely a preferred embodiment of the invention, and that other embodiments are contemplated within the scope of the claims hereafter set forth.

DETAILED DESCRIPTION OF THE INVENTION

Referring to the drawing the present condensation proof glass assembly generally indicated at 11 includes glass container 13, normally a drinking glass, with its lower portion projected snugly down into plastic insulator cup 15.

The cup is constructed of suitable plastic material such as polystyrene or polyethylene or the like.

The inner surface 17 of the cup is of predetermined shape, tapered and generally circular, and is adapted to receive the similiarly shaped outer surface 19 of the glass container 13.

A plurality of upright substantially parallel grooves 21 providing elongated drip channels are formed in the outer surface of the container defining corresponding ridges 25 of arcuate form.

Figure 2:
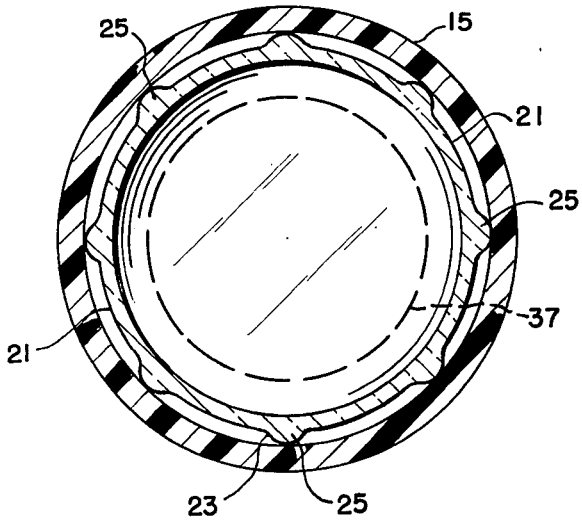
FIG. 2 is a plan section taken in the direction of arrows 2—2 of FIG. 1.

Said channels are generally concave transversely as shown at 21 FIG. 2, with the outer longitudinal edges tapering outwardly as at 23 merging in with and defining ridges 25. These are adapted to snugly and frictionally engage the tapered interior wall surface of plastic insulator cup 15. The channels are of gradually increasing width as shown at 29 towards the bottom wall 31 of the glass container.

The insulator cup includes bottom wall 33, which in the assembly shown in FIG. 1 as used, is spaced from the container bottom wall 31 to define the spill over condensation reservoir 35.

In operation and in use with a cold liquid within the container 13 any condensation normally forming upon the exterior of said container moves by gravity downward and into the respective grooves or drip channels 21 for collection down in the reservoir 35.

This prevents the holders hand from getting wet and protects the outside surface of the glass where held, and protects any piece of furniture onto which the assembly is placed. Another advantage is that the cup insulates the glass container from the heat of the users hand. Water is prevented from dropping on the users clothes.

A throw-a-way absorbent insert disc 37, of paper or the like, is nested within reservoir 35 upon cup bottom wall 33.

The end product provides an improved glass assembly which overcomes the disadvantages heretofore described, provides a very usable drinking glass combination. The normally contained cold liquids are insulated from the users hand by the protective plastic cup 15.

The same insulator, however, is useful for hot beverages.

Having described my invention reference should now be had to the following claims.

I claim:

1. A condensation proof glass assembly comprising a cup of plastic material having an inner wall surface of predetermined shape, and a bottom wall;

a glass container with a lower outer wall surface of substantially the same shape as the cup inner wall and having a bottom wall;

snugly and frictionally projected down into said cup;

said bottom walls being spaced apart defining a spill over and condensation reservoir;

a plurality of upright substantially parallel grooves in the outer surface of the container defining corresponding ridges engaging said cup for a series of line contacts therewith;

said grooves forming a series of drip channels conducting water to said reservoir;

said grooves extending from intermediate the height to the bottom of the container;

said cup extending over about the lower one half of the container;

said grooves being concave in shape transversely of the container, of gradually increasing width;

and decreasing depth towards the container bottom.

2. In the glass assembly of claim 1, a throw away absorbent insert disc on the cup bottom wall within said reservoir.

* * * * *